US006944884B1

(12) United States Patent
Sokolowski

(10) Patent No.: US 6,944,884 B1
(45) Date of Patent: Sep. 20, 2005

(54) GLOVE WITH A WEB STRUCTURE

(75) Inventor: Susan L. Sokolowski, Portland, OR (US)

(73) Assignee: Nike, Inc., Beaverton, OR (US)

( * ) Notice: Subject to any disclaimer, the term of this patent is extended or adjusted under 35 U.S.C. 154(b) by 190 days.

(21) Appl. No.: 10/246,754

(22) Filed: Sep. 19, 2002

(51) Int. Cl.[7] ..... A41D 19/00
(52) U.S. Cl. ..... 2/161.1
(58) Field of Search ..... 2/16, 20, 21, 160, 2/161.1–161.6, 163, 167

(56) References Cited

U.S. PATENT DOCUMENTS

| | | | | |
|---|---|---|---|---|
| 811,389 | A | 1/1906 | Ferry | |
| 859,097 | A | 7/1907 | Miller | |
| 883,761 | A | 4/1908 | Taylor | |
| 3,194,233 | A | 7/1965 | Peckham | |
| 3,944,220 | A | 3/1976 | Fasano | |
| 4,353,362 | A | 10/1982 | DeMarco | |
| 4,766,612 | A | 8/1988 | Patton, Sr. | |
| 4,872,448 | A | 10/1989 | Johnson, Jr. | |
| 4,881,275 | A | 11/1989 | Cazares et al. | |
| 4,891,845 | A | 1/1990 | Hayes | |
| 4,937,882 | A | 7/1990 | Hayes | |
| 5,031,238 | A | 7/1991 | Hayes | |
| 5,214,798 | A | 6/1993 | McLaughlin | |
| 5,345,609 | A * | 9/1994 | Fabry et al. | 2/20 |
| 5,373,585 | A | 12/1994 | Wiggins | |
| 5,527,244 | A | 6/1996 | Waller et al. | |
| 5,544,362 | A | 8/1996 | Synek | |
| 5,581,809 | A * | 12/1996 | Mah | 2/20 |
| 5,697,103 | A | 12/1997 | Wiggins | |
| 5,708,979 | A | 1/1998 | Redwood et al. | |
| 6,289,515 | B1 | 9/2001 | Fous | |
| 6,543,058 | B2 * | 4/2003 | Litke | 2/161.2 |
| 6,681,402 | B1 * | 1/2004 | Bevier et al. | 2/19 |
| 6,772,441 | B2 * | 8/2004 | Lucas, Jr. | 2/161.1 |

FOREIGN PATENT DOCUMENTS

| | | |
|---|---|---|
| JP | 7213675 | 8/1995 |

* cited by examiner

*Primary Examiner*—Katherine M Moran
(74) *Attorney, Agent, or Firm*—Banner & Witcoff, Ltd.

(57) ABSTRACT

An article of apparel, particularly a glove, is disclosed that incorporates a web structure for providing support to the hand. The web structure includes a plurality of segments that are interconnected and located on the back of the hand. The web structure may include a plurality of extensions that extend onto the fingers and the wrist to provide support in these areas when the glove is worn upon the hand.

19 Claims, 11 Drawing Sheets

GLOVE WITH A WEB STRUCTURE

BACKGROUND OF THE INVENTION

1. Field of the Invention

The present invention relates to athletic apparel. The invention concerns, more particularly, a protective glove with a web structure that may be worn by individuals engaged in activities such as weightlifting.

2. Description of Background Art

The primary purpose of many glove designs is to protect and support the hand. In this regard, protective gloves often include insulation to protect the hand from temperature extremes, padding to protect the hand from compressive forces, or durable materials to protect the hand from shear forces or abrasion. In addition, protective gloves may include features such as wrist straps and elastic materials to ensure that the gloves remain securely positioned on the hands during use.

Factors that govern glove design include the activities during which the glove will be worn and the conditions and environment in which the glove is intended to be worn. Accordingly, the design of a glove may incorporate multiple protective features and elements that combine to form a glove with a specialized purpose. Weightlifting gloves, for example, often include foam or other padding to protect the hand from the compressive action of barbells, dumbbells, or other weightlifting equipment. When grasping heavy exercise equipment with a bare hand, the exercise equipment may compress localized areas of the hand. Padding serves the purpose of distributing compressive forces over a greater area of the hand, thereby minimizing compressive forces in any particular area of the hand. Weightlifting gloves may also include a durable covering, such as leather, on the palm and fingers to ensure that the hand is adequately protected from abrasive forces during exercise. In addition, weightlifting gloves may include breathable, water permeable materials that wick perspiration away from the surface of the hand and permit air to envelop and cool the hand.

Heavy weightlifting equipment has the potential to distort the natural structure of the hand when grasped by the hand. Accordingly, some weightlifting gloves include structures that purport to align the bones of the hand. An example of this type of glove is disclosed in U.S. Pat. No. 4,546,495 to Castillo, which includes a tapered wedge located on the palmar surface of the hand. U.S. Pat. No. 5,517,694 to Fabry discloses a glove with an elongated strap that may be wrapped tightly around the hand during weightlifting activities.

A weightlifting glove may also be designed in consideration of the potential effects that the glove itself may have upon the hand. As discussed above, exercise equipment may compress localized areas of the hand. Such compressions may merely cause discomfort, but may also result in the formation of calluses or blisters. Seams located on the interior of the glove and adjacent to the hand may also compress localized areas of the hand, particularly when the seams are located in contact with the hand. Accordingly, seams may also cause discomfort or result in the formation of calluses or blisters.

SUMMARY OF THE INVENTION

The present invention is a glove that covers and protects at least a portion of a hand. The glove includes a web structure located on a dorsal side of said glove. The web structure is formed of a flexible material and has a plurality of interconnected segments that define openings located between the segments. The web structure may also include a plurality of extensions that extend into finger and wrist areas of the glove.

The segments forming the web structure may be arranged to form a variety of arrangements for the segments, including configurations that resemble a web. The web structure provides support for the fingers, hand, wrist, and lower arm when carrying, lifting, or otherwise grasping heavy objects. In addition, the web structure may align the bones in the hand and wrist, thereby promoting proper hand posture when grasping heavy objects.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Figure 1:
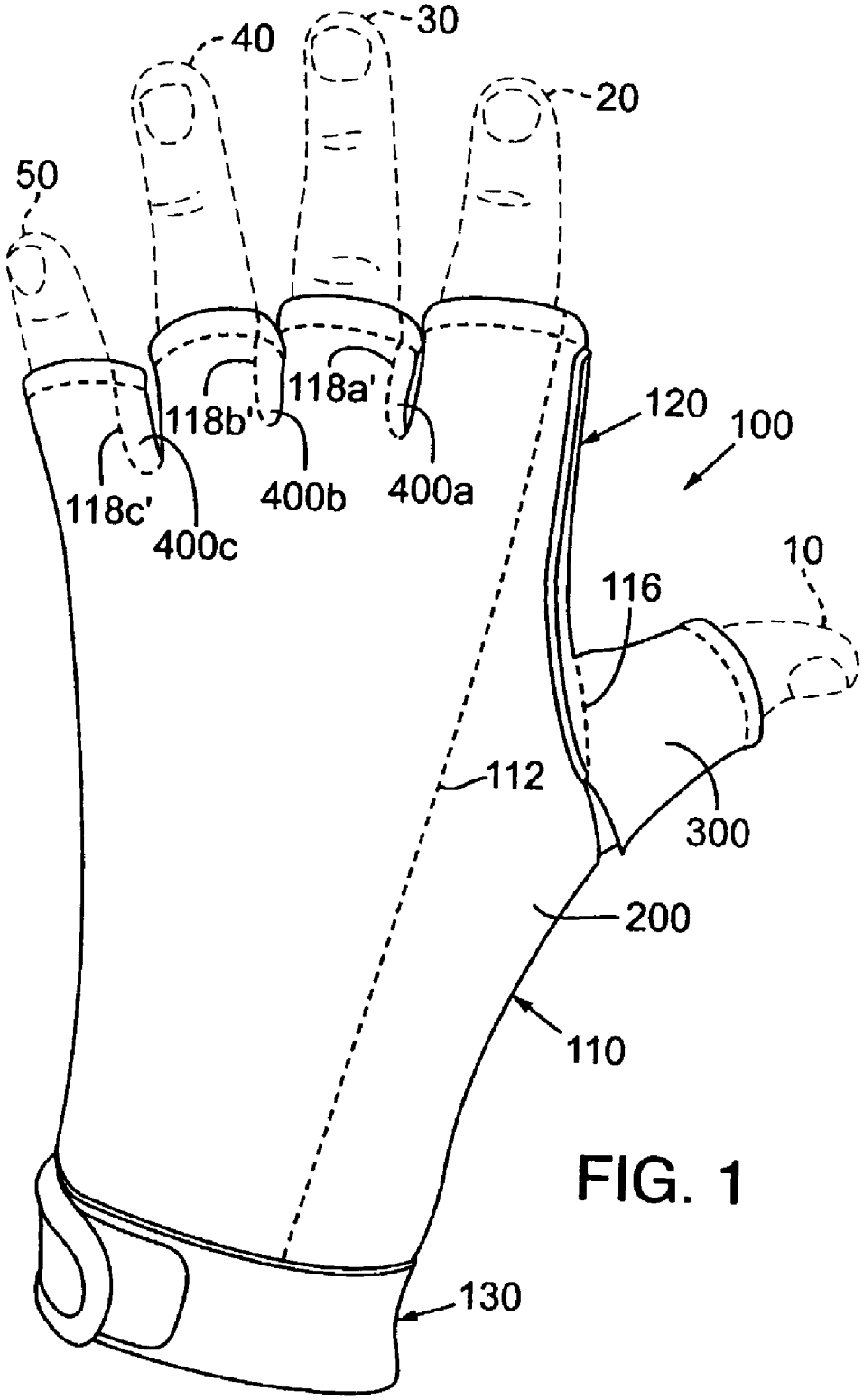
FIG. 1 is a dorsal plan view of a first glove in accordance with the present invention.

The following discussion and accompanying figures disclose a protective glove 100 in accordance with the present invention Glove 100 is described and depicted as a glove that is suitable for weightlifting activities. The concepts disclosed below, however, are not intended to be limited solely to weightlifting gloves. Rather, the concepts may be applied to gloves with a variety of intended uses, particularly where the intended uses involve lifting, carrying, or otherwise grasping objects.

In the following discussion the various portions of glove 100 will be discussed with reference to adjacent portions of the hand and wrist, including a palmar side of the hand, an opposite dorsal side of the hand, various digits or phalangeal bones, metacarpal bones, wrist bones, and joints between the various bones. The digits, which include first digit 10, second digit 20, third digit 30, fourth digit 40, and fifth digit 50, are identified for reference in the figures. One skilled in the relevant art will recognize that hands have a multiplicity of shapes and sizes. Accordingly, references to the various portions of the hand are only meant to provide a general understanding regarding the location of the various elements of glove 100.

Figure 2:
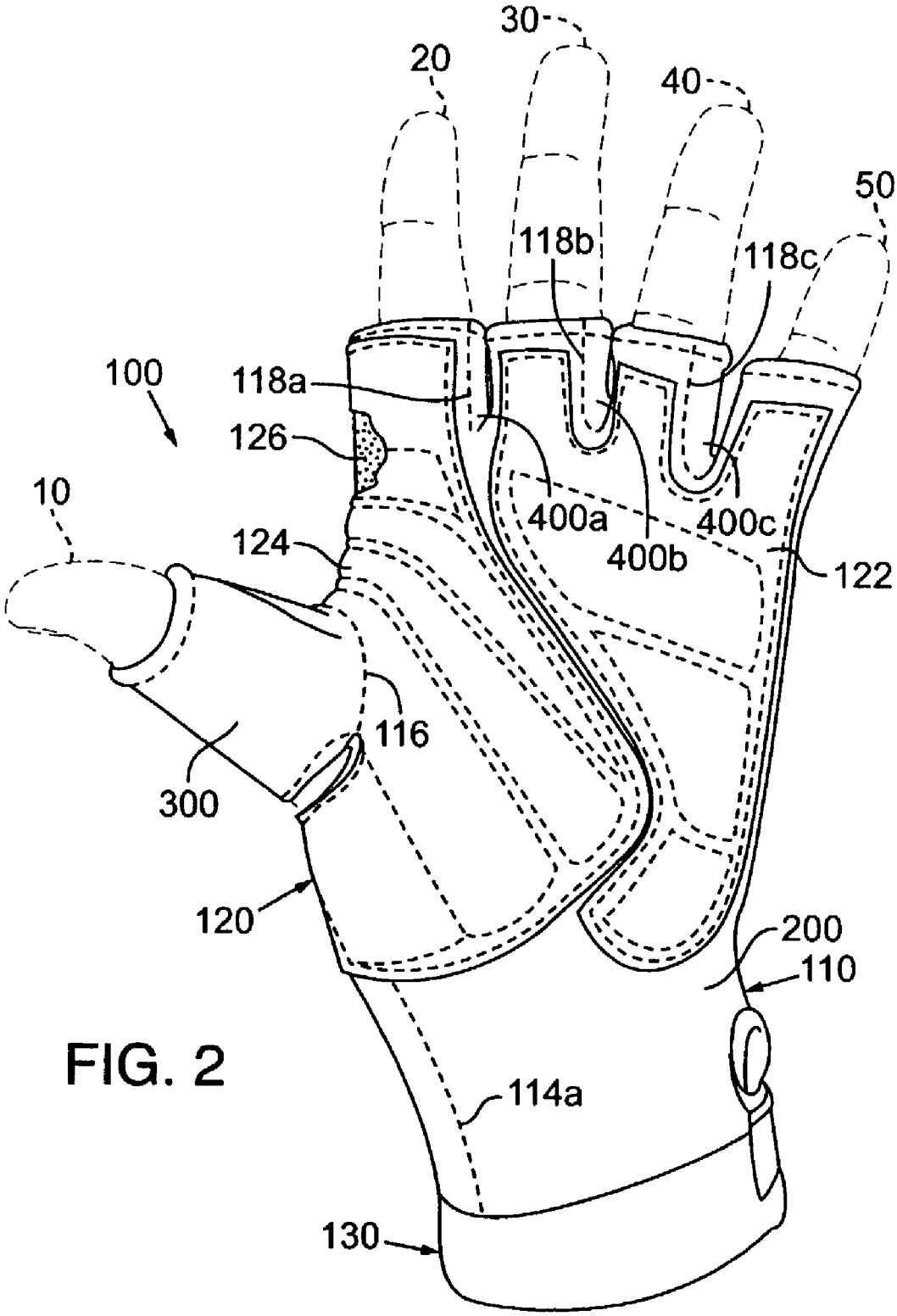
FIG. 2 is a palmar plan view of the first glove.
Figure 3:
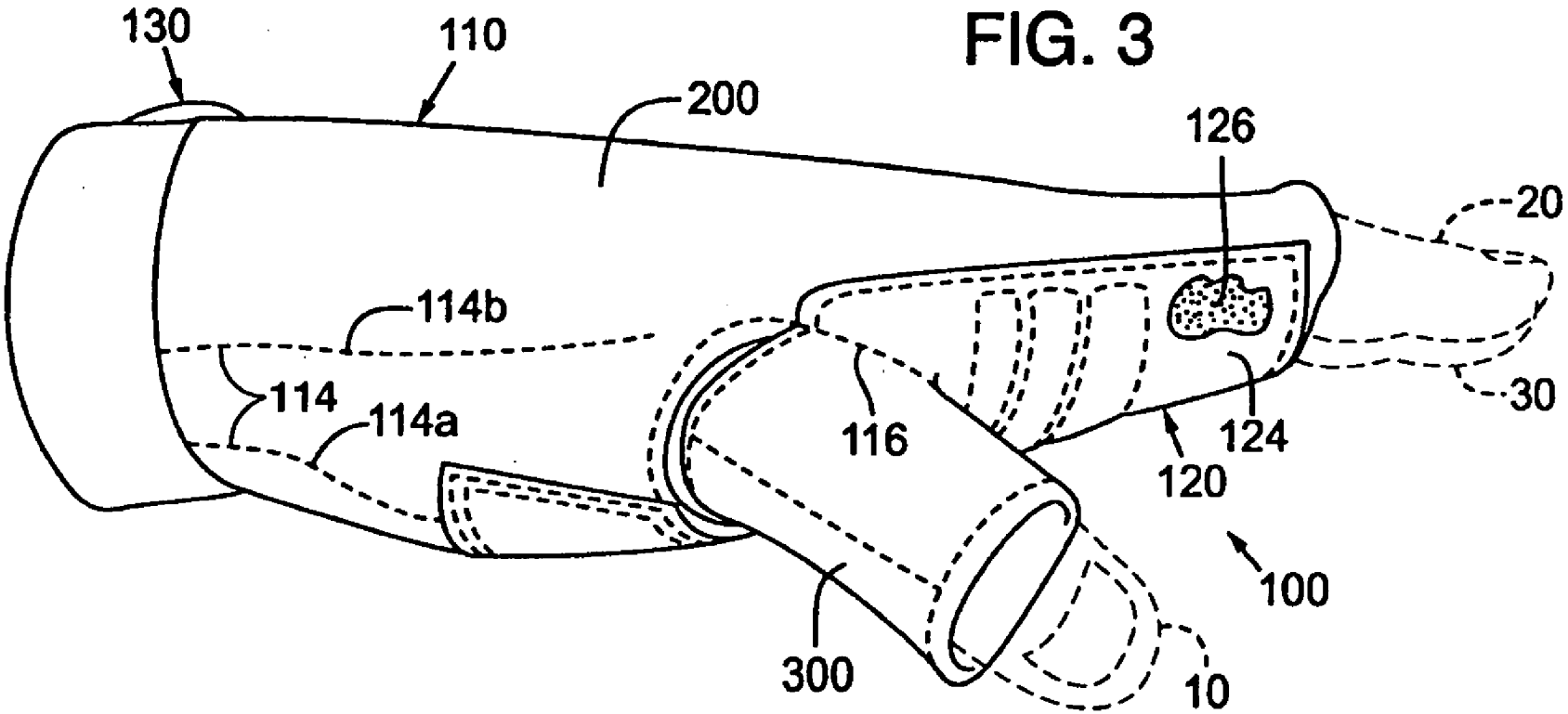
FIG. 3 is a medial side elevational view of the first glove.
Figure 4:
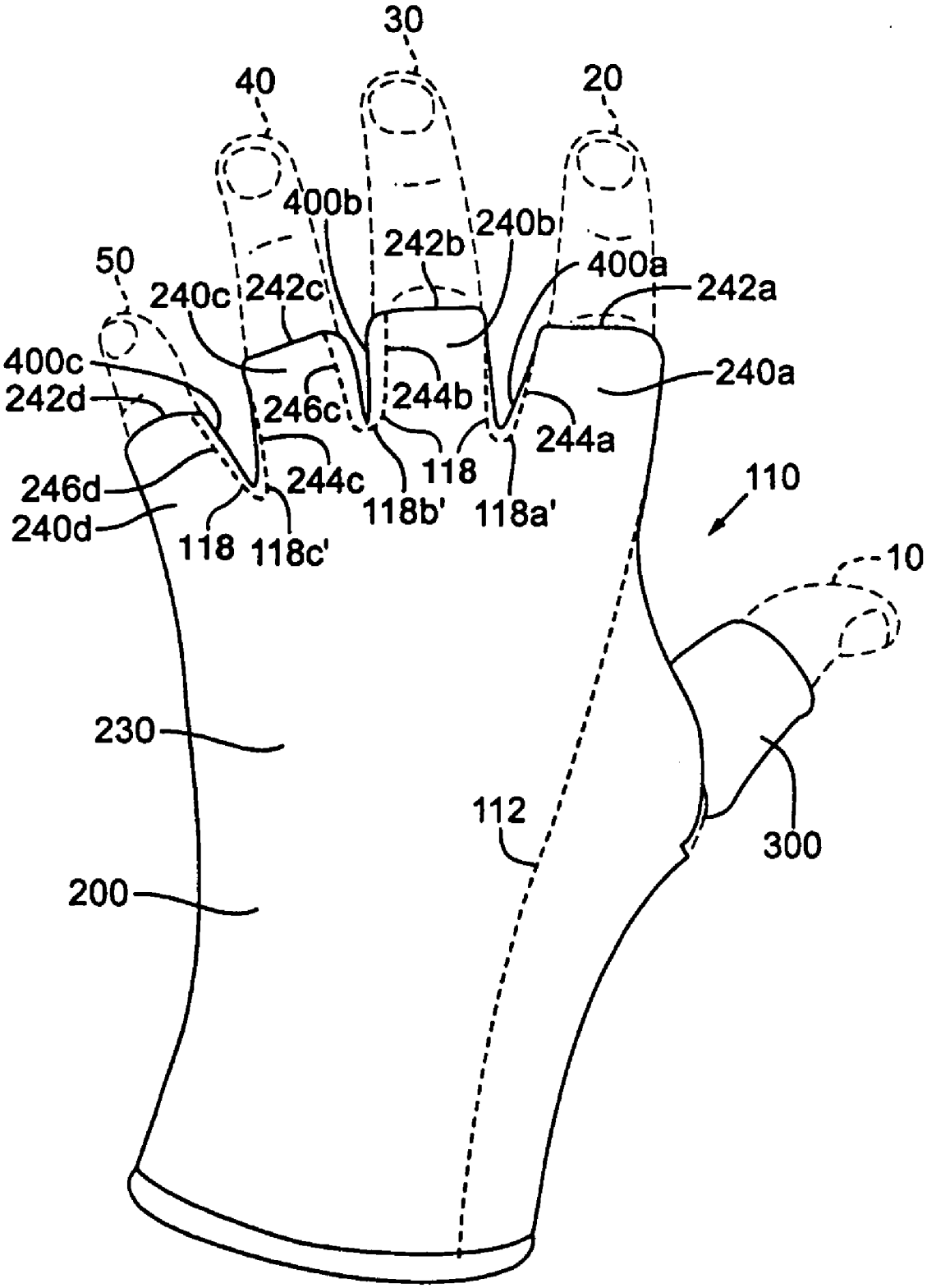
FIG. 4 is a dorsal plan view of a base portion of the first glove.
Figure 5:
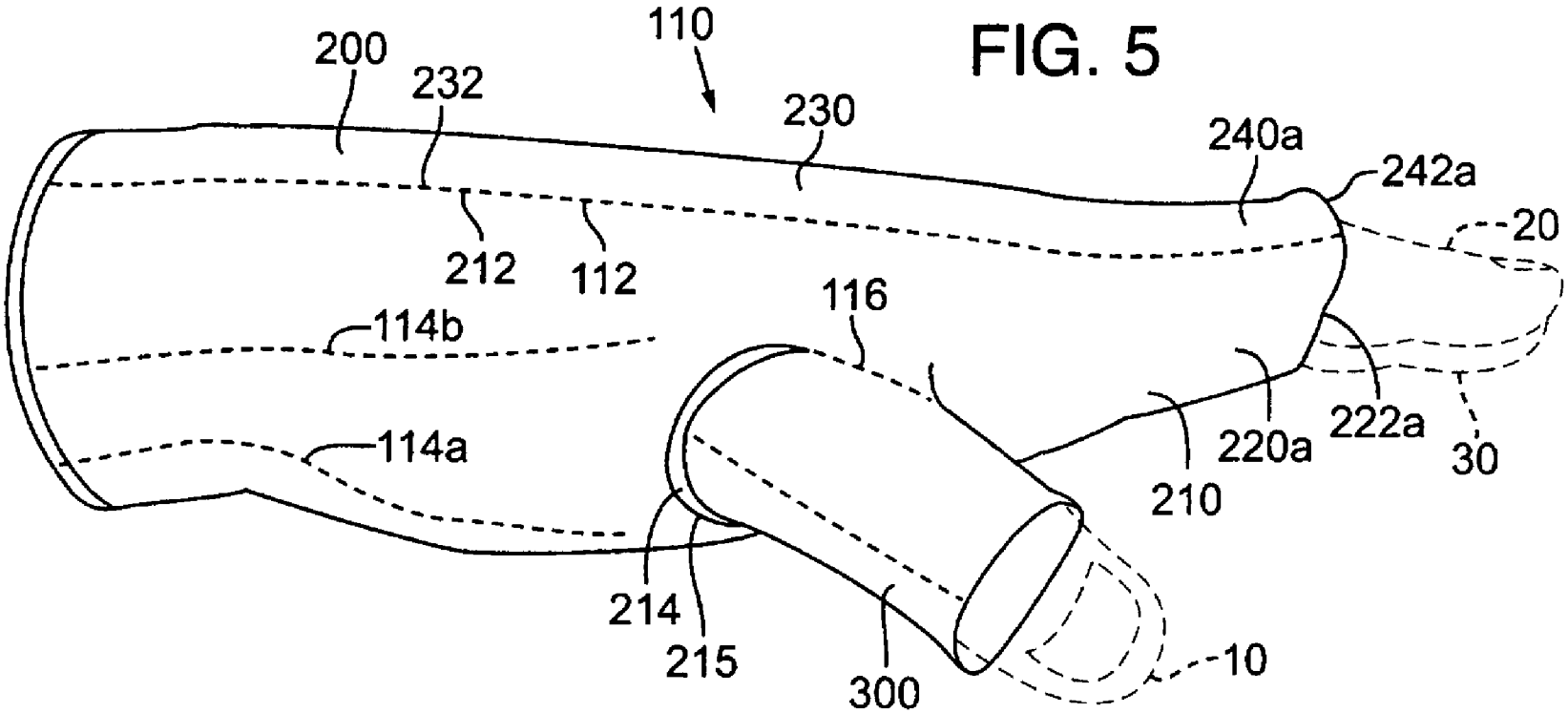
FIG. 5 is a medial side elevational view of the base portion.

Glove 100 is depicted in FIGS. 1–3 and includes a base portion 110, a protective portion 120, and a wrist strap 130 that combine to form a comfortable and protective weight-lifting glove for receiving a hand of a wearer. During weightlifting activities, the hand is repetitively used to securely grip relatively heavy objects, such as weights, barbells, dumbbells, and other exercise equipment. Seams that are located in contact with the hand and between the hand and a gripped object have the potential to cause discomfort. That is, glove seams that are compressed into the surface of the hand when grasping heavy objects may cause the wearer discomfort, and repetitive contact between the seams and the hand may also cause chafing, blistering, or the formation of calluses on the hand. As will be discussed in greater detail below, base portion 110 decreases the adverse impact of seams by minimizing the presence of seams in areas of glove 100 that contact the hand and are commonly compressed between the hand and gripped objects. Protective portion 120 is attached to base portion 110 and is primarily located on the palmar surface of base portion 110, thereby providing an additional layer of protective material that is positioned between the hand and gripped objects. Wrist strap 130 may be a conventional wrist strap that serves to secure glove 100 to the hand.

Figure 6:
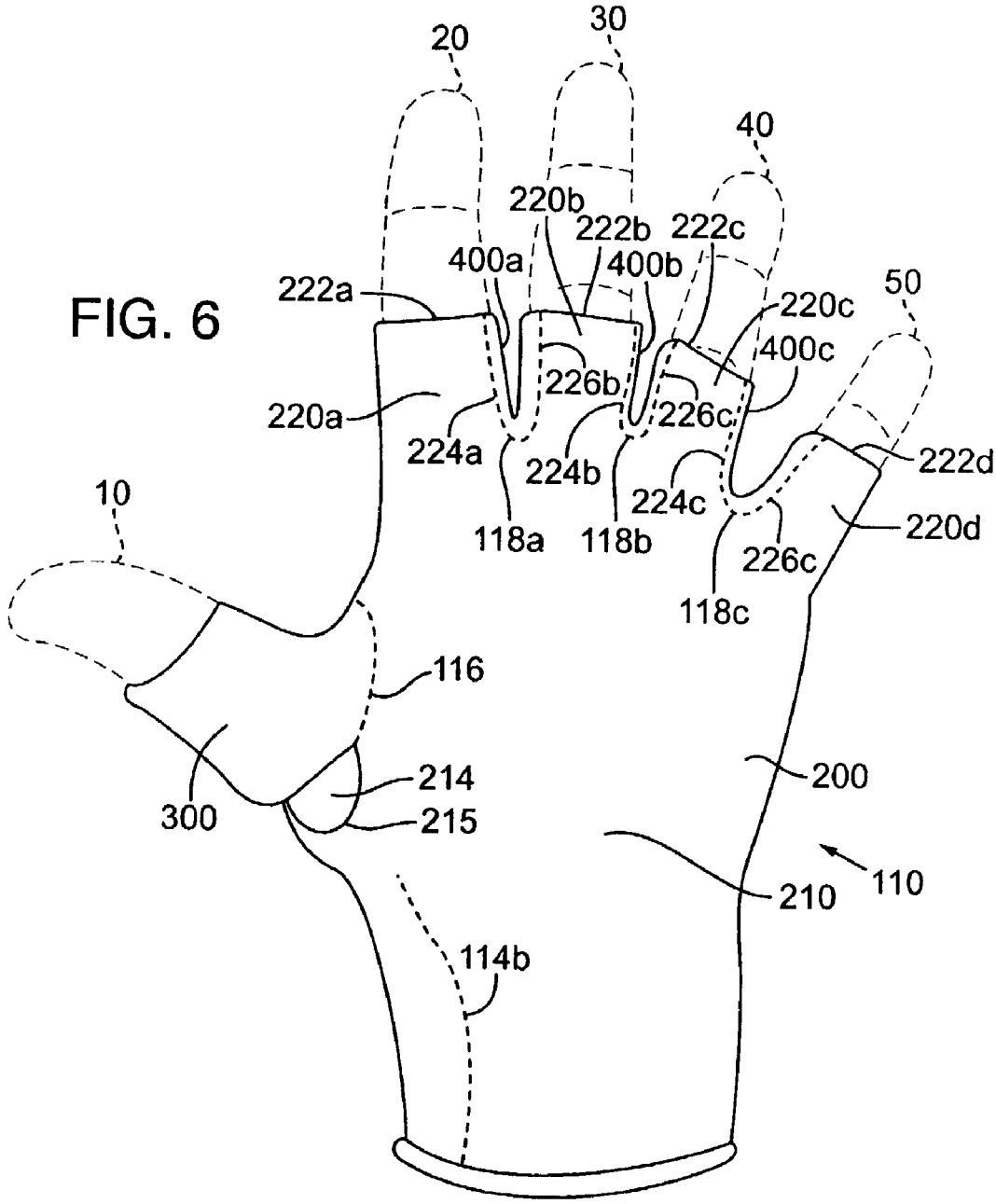
FIG. 6 is a palmar plan view of the base portion.
Figure 7:
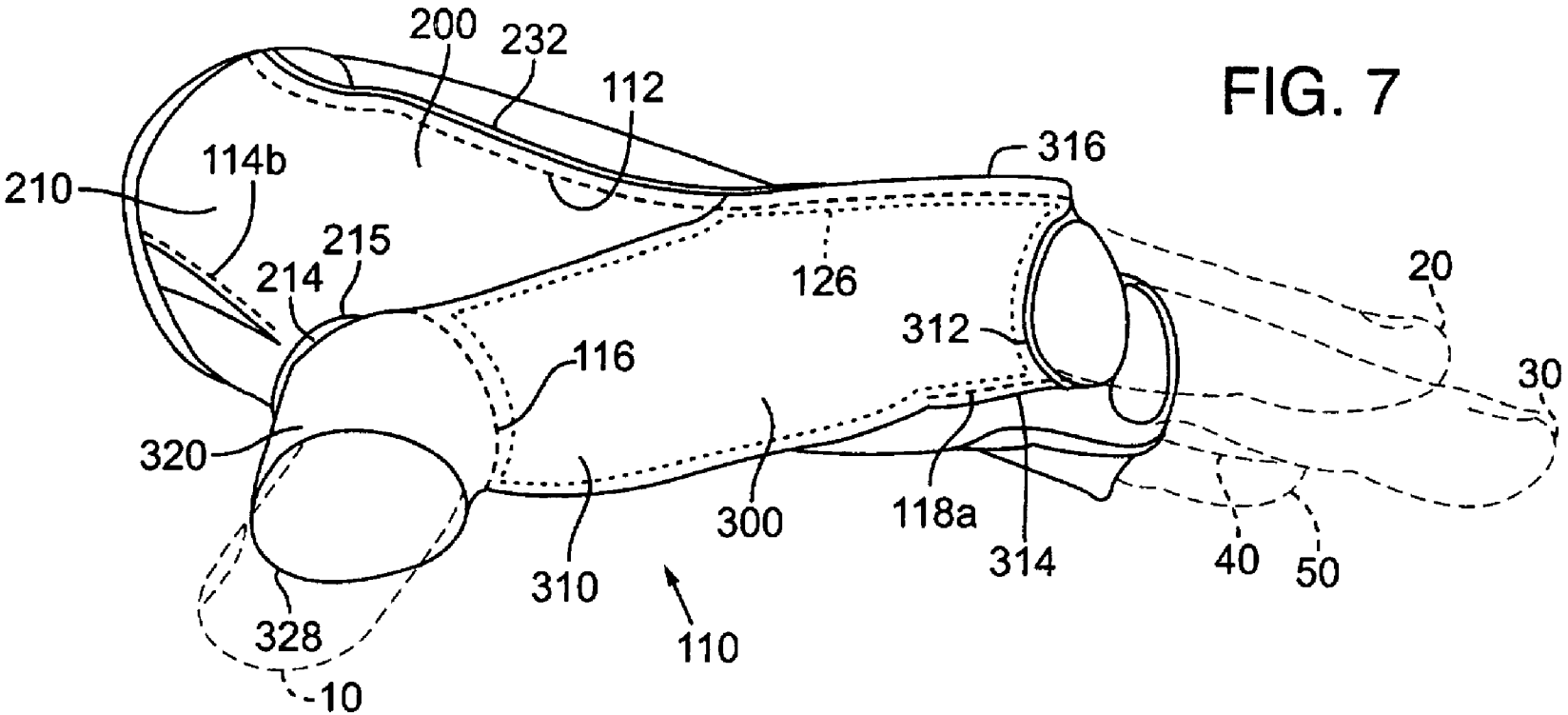
FIG. 7 is a medial side elevational view of the base portion in an inside-out configuration that shows the internal structure of the base portion.
Figure 8:
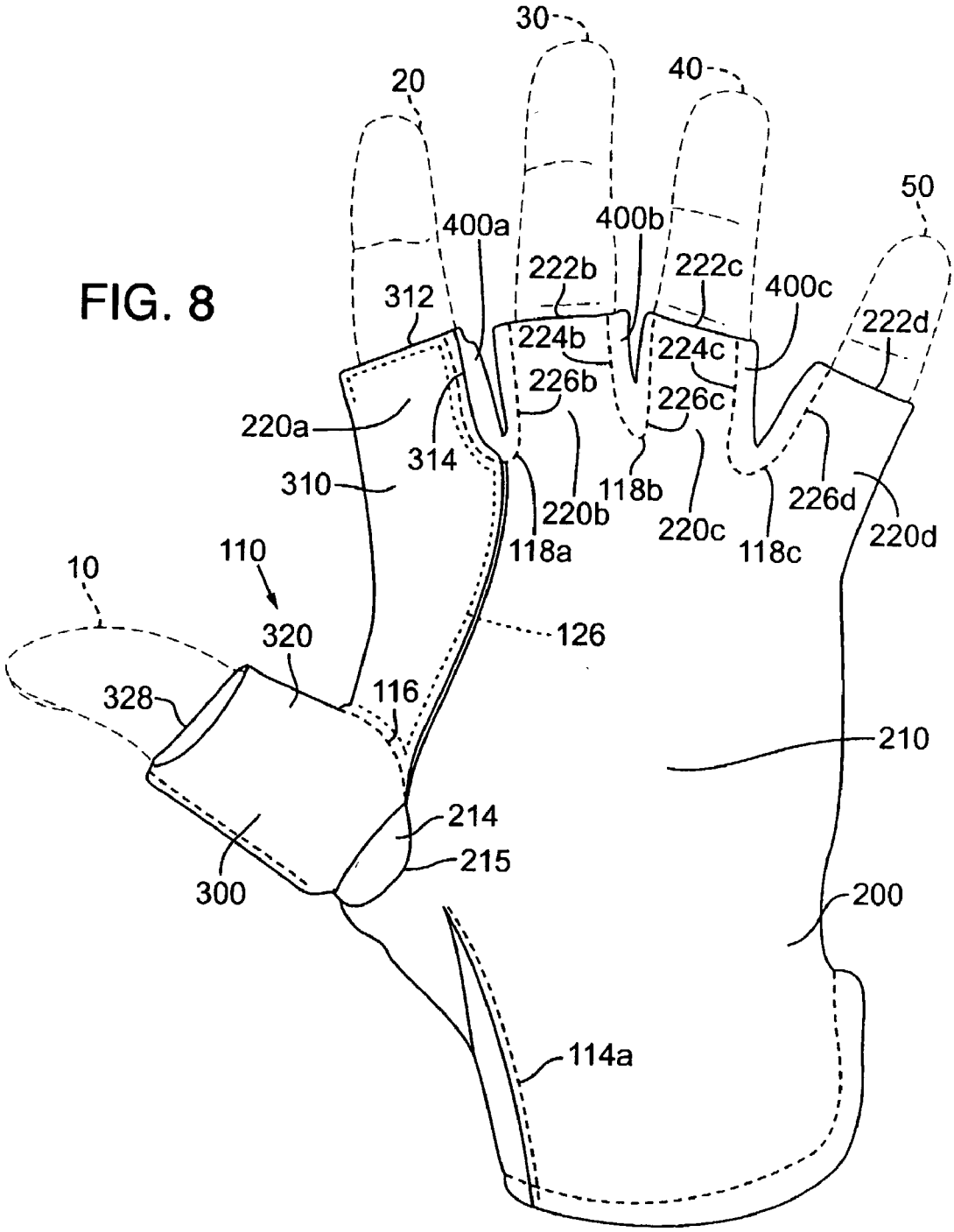
FIG. 8 is a palmar plan view of the base portion in the inside-out configuration.

Base portion 110 is depicted individually in FIGS. 4–8, with FIGS. 7 and 8 depicting base portion 110 in an inside-out configuration that shows the internal structure of base portion 110. The principal seams on base portion 110 are a longitudinal seam 112, a pair of wrist seams 114, a first digit seam 116, and a plurality of gusset seams 118. Longitudinal seam 112 extends along the second digit, across a dorsal portion of the second metacarpal, and onto the wrist. Accordingly, longitudinal seam 112 is located primarily on the dorsal surface of the hand, which rarely experiences the compressive forces that cause discomfort when gripping objects. As best seen in FIG. 3, wrist seams 114*a* and 114*b* extend from the base of the of the first digit on the palmar and dorsal sides of the hand to the wrist. First digit seam 116 is located at the base of the first digit. Finally, gusset seams 118 are located between the second through fifth digits. This design, therefore, substantially limits the presence of seams on the palmar surface of the hand, thereby limiting discomfort, chafing, or blistering, for example.

Figures 9, 10, 11:
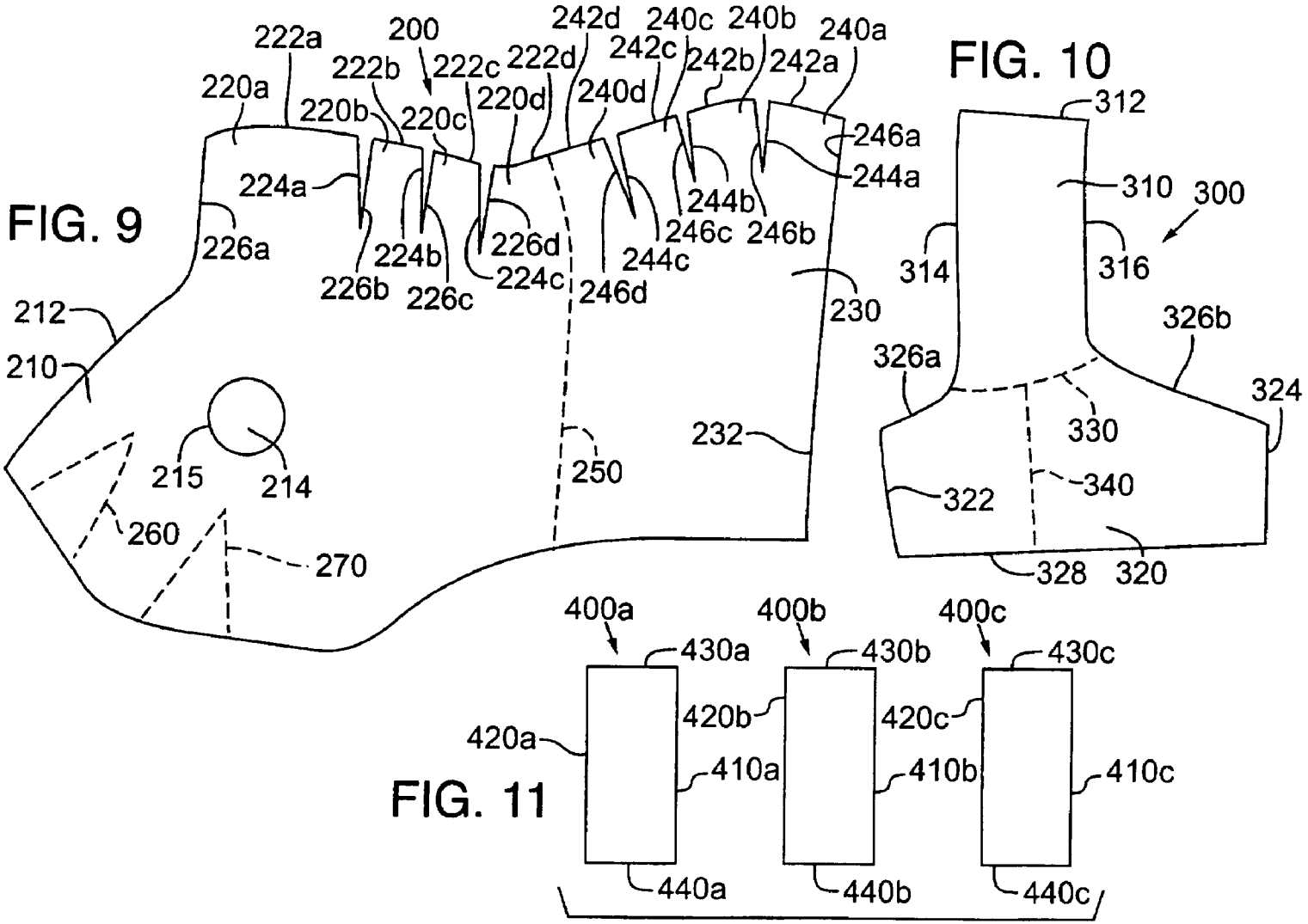
FIG. 9 is a plan view of a pattern for a primary element of the base portion.
FIG. 10 is a plan view of a pattern for a secondary element of the base portion.
FIG. 11 is a plan view of patterns for gusset elements of the base portion.

Seams 112, 116, and 118 join the primary components of base portion 110, which include a primary element 200, a secondary element 300, and three gusset elements 400*a*–400*c*. Primary element 200 covers a majority of a palmar surface and an opposite dorsal surface of the hand, including a portion of the second through fifth digits, and a portion of the wrist. Unlike many conventional gloves that utilize multiple, joined elements to cover these areas, a single section of material is utilized as primary element 200. With reference to FIG. 9, the pattern for primary element 200 is disclosed.

Primary element 200 includes a palmar region 210 and a dorsal region 230 that are generally separated by a line 250. The various regions of primary element 200, including palmar region 210 and dorsal region 230, discussed herein are not intended to be precisely defined areas. Instead, the regions are intended to aid in discussion by representing general regions of primary element 200. Palmar region 210 further includes four palmar digit regions 220*a* to 220*d* that correspond with the second through fifth digits, respectively, a palmar edge 212, and an aperture 214. Palmar digit regions 220 include ends 222, lateral edges 224, and medial edges 226. Similarly, dorsal region 230 includes four digital regions 240*a*–240*d* that correspond with the second through fifth digits, respectively, and a dorsal edge 232. Dorsal digital regions 240 include ends 242, lateral edges 244, and medial edges 246. Note that palmar digit region 220*d* is formed integral with dorsal digit region 240*d*. Accordingly, palmar digit region 220*d* does not include a lateral edge 224 and dorsal digit region 230*d* does not include a lateral edge 244.

Secondary element 300, depicted in FIG. 10, is a generally T-shaped element that includes a pocket region 310 and a first digit region 320 generally separated by a line 330. As with primary element 200, the various regions of secondary element 300, including pocket region 310 and first digit region 320, are not intended to be precisely defined regions. Instead, the regions are intended to aid in discussion by representing general areas of secondary element 300. Pocket region 310 further includes an end 312, a lateral edge 314, and a medial edge 316. First digit region 320 includes a lateral edge 322, a medial edge 324, a pair of base edges 326*a* and 326*b*, and an end 328. Gusset element 400*a*, depicted in FIG. 11, includes a palmar edge 410*a*, a dorsal edge 420*a*, a first end portion 430*a*, and a second end portion 440*a*. Gusset elements 400*b* and 400*c* include palmar edges 410*b* and 410*c*, dorsal edges 420*b* and 420*c*, first end portions 430*b* and 430*c*, and second end portions 440*b* and 440*c*, respectively.

With respect to base portion 110, pocket region 310 of secondary element 300 extends from the base of the first digit, along the side of the hand between the first and second digit and along portions of the second digit, as depicted in FIGS. 7 and 8. Accordingly, the position of pocket region 310 corresponds with the area of the hand between the first and second digits. The purpose of pocket region 310 is to form a pocket between primary element 200 and secondary element 300 for receiving an additional element of protective portion 120, thereby providing additional protection in the area between the first and second digits and along the second digit. That is, pocket region 310 forms a pocket that receives additional protective material. Alternately, pocket region 310 may form an element to which a section of protective portion 120 may be attached. Accordingly, the section of protective portion 120 may be located within the pocket formed between primary element 200 and secondary element 300, or the section of protective portion 120 may be attached to the side of pocket region 310 that contacts the hand.

First digit region 320 protrudes through aperture 214 and forms a generally cylindrical structure for receiving the first digit. The cylindrical structure is formed by attaching lateral edge 322 and medial edge 324 of first digit region 320 to each other. Secondary element 300 may also be attached to primary element 200 by sewing line 330 to edge 215 of aperture 214 to form seam 116. In this configuration, secondary element 300 is attached to only a portion of edge 215, thereby forming an articulated connection that facilitates flexing of the first digit.

A method of attaching elements 200, 300, and 400 to form base portion 110 will now be discussed in order to provide further understanding regarding the structure of base portion 110 and the interrelationships of the various components that form base portion 110. Depending upon the specific manufacturing technique employed or equipment utilized, the steps for forming base portion 110 may be performed in an order that varies from the order discussed below. For purposes of the present discussion, however, a method that provides the reader with a comprehensive understanding of the structure of base portion 110 will be discussed.

In a first step, primary element 200 is generally folded such that dorsal region 230 overlaps palmar region 210, palmar digit regions 220 are generally aligned with dorsal digit regions 240, and palmar edge 212 lies adjacent to dorsal edge 232. Longitudinal seam 112 may then be partially formed by attaching palmar edge 212 to dorsal edge 232. As will become apparent in the discussion below, the portion of longitudinal seam 112 adjacent to palmar digit region 220*a* and dorsal digit region 240*a* should be formed in a subsequent step. Note that longitudinal seam 112, as well as the other seams discussed herein, may be formed through a variety of attachment techniques, including sewing or adhesive bonding, for example. The partial formation of longitudinal seam 112 provides primary element 200 with a configuration wherein edges 212 and 232 are partially attached to each other, but the remaining portions of palmar region 210 and dorsal region 230 remain unattached, thereby forming an enclosed area between palmar region 210 and dorsal region 230 for receiving the hand.

In a second step, pocket region 310 of secondary element 300 is inserted through aperture 214 and located within the enclosed area between palmar region 210 and dorsal region 230. Note that first digit region 320 remains outside primary element 200. Pocket region 310 is then positioned such that end 312 is substantially aligned between end 222*a* of palmar region 210 and end 242*a* of dorsal region 230; lateral edge 314 is aligned between lateral edge 224*a* and lateral edge 244*a*; and medial edge 316 is aligned between medial edge 226*a* and medial edge 246*a*. The unattached portion of longitudinal seam 112 from the first step may now be completed by simultaneously attaching medial edge 226*a* and medial edge 246*a* to at least a portion of medial edge 316. At this stage, secondary element 300 is partially incorporated into base portion 110 and longitudinal seam 112 is complete.

In a third step, the area of glove 100 that receives the first digit is formed from first digit region 320 by folding first digit region along line 340 and attaching lateral edge 322 to medial edge 324. In this manner, first digit region 320 is configured to form a generally cylindrical structure that aligns with aperture 214. The portion of secondary element 300 represented by line 330 is then sewn to aperture edge 215 to form first digit seam 116. Accordingly, a first digit of a wearer that extends through aperture 214 is directed within first digit region 320. Note that first digit flexibility and the ventilation properties of glove 100 may be enhanced by leaving base edges 326*a* and 326*b* unattached to aperture edge 215 such that first digit seam 116 extends only partially around aperture 214, as depicted in FIGS. 2, 3, and 6, for example. In alternate embodiments, base edges 326*a* and 326*b* may be fully attached to aperture edge 215.

In a fourth step, gusset elements 400 are attached to the areas between the second through fifth digits. With respect to gusset element 400*a*, palmar edge 410*a* is attached to both lateral edge 224*a* and medial edge 226*b* to form a first gusset seam 118*a* (see FIG. 6). Note that lateral edge 314 is positioned between palmar edge 410*a* and lateral edge 224*a* and is also attached with first gusset seam 118*a* (see FIG. 8). In addition, dorsal edge 420*a* is attached to both lateral edge 244*a* and medial edge 246*b* to form a second gusset seam 118*a*' (see FIG. 4). In this configuration end 430*a* is aligned with ends 222*a* and 242*a*, and end 440*a* is aligned with ends 222*b* and 242*b*. Gusset element 400*b*, which is located between the third and fourth digits, and gusset element 400*c*, which is located between the fourth and fifth digits, may also be attached to remaining edges 224 and 226 of palmar region 210 and the remaining edges 244 and 246 of dorsal region 230, thereby forming gusset seams 118*b*, 118*b*', 118*c*, and 118*c*'.

With regard to pocket region 310, lateral edge 314 and medial edge 316 are effectively attached to edges 224*a* and 226*a* of palmar digit region 220*a* such that pocket region 310 lies adjacent to palmar digit region 220*a* and extends to aperture 214. In the area between palmar digit region 220*a* and aperture 214, pocket region 310 is unattached to primary element 200. As discussed above, therefore, this configuration forms a pocket in which a portion of the protective material from protective portion 120 may be positioned. With reference to FIGS. 2 and 3, protective portion 120 is depicted. Although FIGS. 7 and 8 illustrate base portion 110, the location of protective portion 126 is depicted.

In a fifth step, wrist seams 114 are formed by folding portions of palmar region 210 and forming a seam at the base of the fold. That is, the circumference of base portion 110 in the wrist area is reduced by darting palmar region 210 in two locations, as depicted by lines 260 and 270 in FIG. 9, thereby forming wrist seams 114. Wrist seams 114 decrease the cross-sectional area of base portion 110, thereby fitting base portion 110 to the wrist area of the wearer. Base portion 110 may also be finished by adding trim or overlocking to prevent the material forming base portion 110 from unraveling or to increase aesthetic appeal.

The material selected for base portion 110 may have a variety of properties depending upon the conditions under which glove 100 is intended to be used. When intended for athletic activities, such as weightlifting for example, a durable material may be selected that wicks moisture away from the hand and permits air to cool the hand. The material may also possess ample stretch characteristics to allow the glove to be comfortably placed upon the hand and removed from the hand. In this regard, suitable materials for base portion 110 may include single or double knit textiles, and the textiles may incorporate an elastic fiber to enhance stretch, such as elastane, which is sold under the LYCRA trademark by E.I. duPont de Nemours and Company. Primary element 200 and secondary element 300 may be formed of differing materials. For example, primary element 200 may be formed of synthetic suede and secondary element 300 may be formed of a supple leather. This configuration provides base portion 110 with additional durability in the area between the first and second digits.

Following completion of base portion 110, as described above, protective portion 120 may be added. In general, protective portion 120 includes one or more elements that are strategically placed on the exterior of base portion 110 to absorb shock and distribute loads. Consequently, the precise configuration of the elements may be varied to suit the demands of the activity for which glove 100 is designed. With reference to FIGS. 1–3, glove 100 is depicted as including three protective elements 122, 124, and 126. Protective element 122 is attached to the exterior of base portion 110 and on the lateral side, and protective element 124 is attached to the exterior of base portion 110 and on the medial side. Suitable materials for protective elements 122 and 124 include a combination of leather and a foam material, for example. More specifically, protective elements 122 and 124 may be formed from suede, leather, durable textiles, or synthetic materials having similar characteristics.

In addition to protective elements 122 and 124, glove 100 also includes protective element 126, which is located on the interior of base portion 110. As described above, a pocket is formed between primary element 200 and secondary element 300 in which protective material may be positioned. That is, pocket region 310 forms a pocket within glove 100. Protective element 126, which is shown in FIGS. 2 and 3, has dimensions approximately corresponding with pocket region 310 and may be positioned between pocket region 310 and primary element 200.

Figure 12:
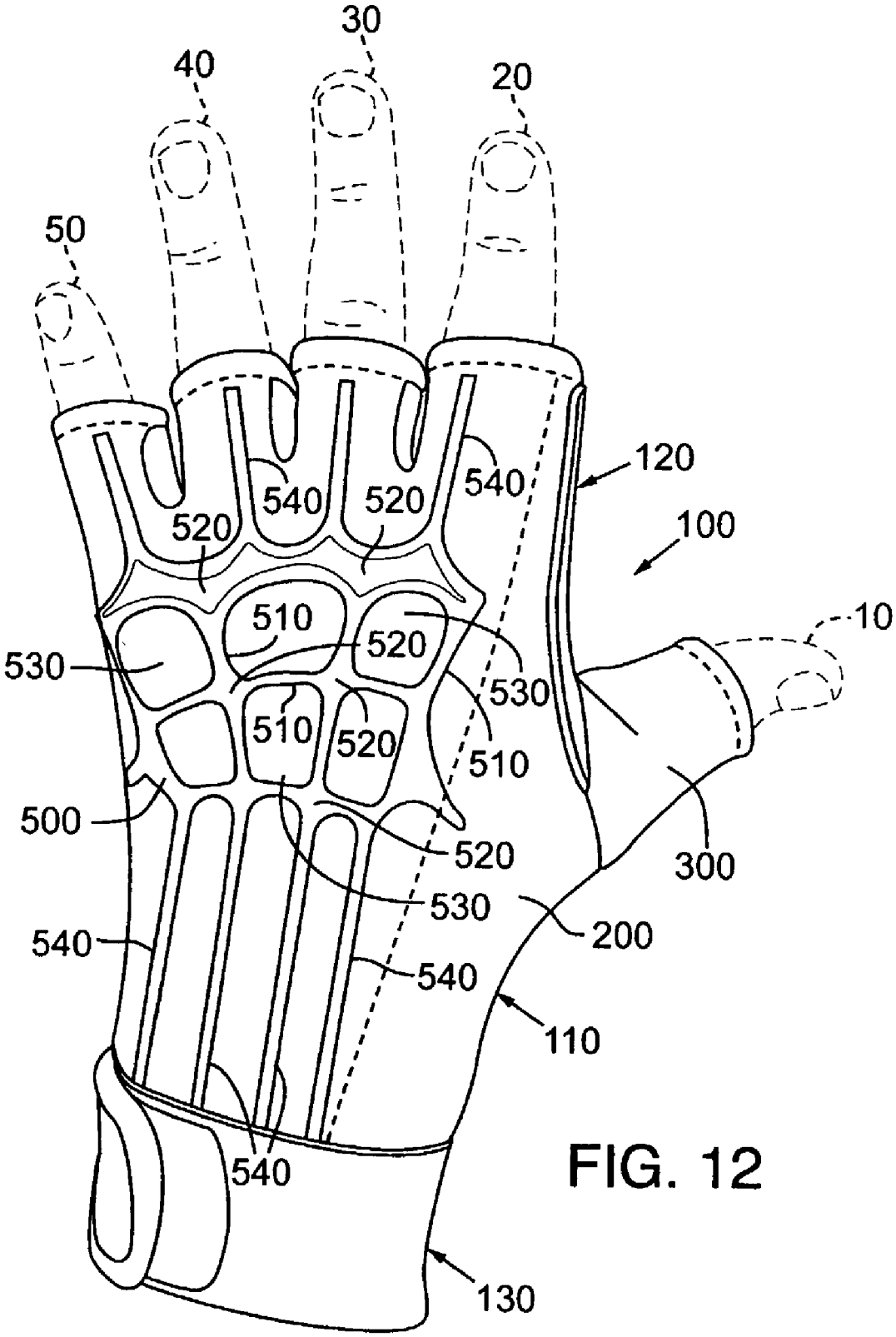
FIG. 12 is a dorsal plan view of a second glove in accordance with the present invention.
Figure 13:
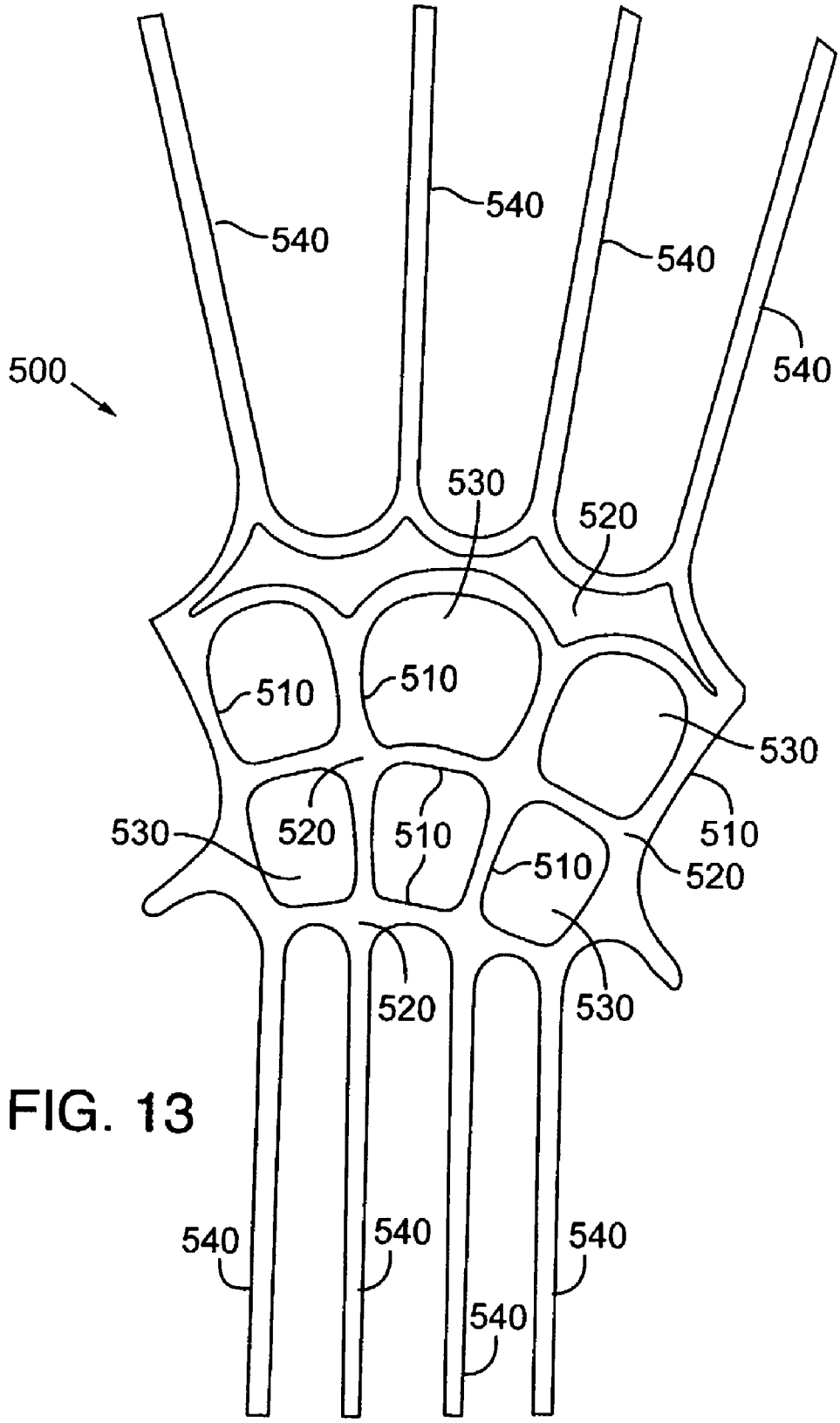
FIG. 13 is a plan view of a web structure of the second glove.

Referring to FIGS. 12 and 13, glove 100 is depicted as including a supportive web 500 positioned on the dorsal surface of base portion 110. Web 500 is an interconnected structure that provides support for the fingers, hand, wrist, and lower arm when carrying, lifting, or otherwise grasping heavy objects, such as weights, barbells, or dumbbells. In addition, web 500 may be utilized to provide feedback concerning the posture of the hand when grasping heavy objects. For example, web 500 may provide pressure to portions of the hand that are not properly aligned when grasping an object, thereby alerting the individual to alter the posture of the hand. In general, web 500 is formed from a multiplicity of segments 510 that are interconnected at junctions 520 to form a web-type structure with a plurality of openings 530 formed between segments 510, thereby forming a structure resembling a web. In addition, web 500 includes a plurality of extensions 540 that extend onto the dorsal surfaces of the fingers and extend downward onto the wrist.

Segments 510 and extensions 540 may be arranged to form a plurality of web configurations. As depicted in the figures, segments 510 are positioned adjacent the metacarpal bones of the hand, thereby forming a plurality of openings 530 on the back of the hand. Extensions 540 extend from the plurality of segments 510 onto the dorsal surfaces of the fingers and the wrist.

One consideration in the design of web 500 is the resulting rigidity and flexibility of glove 100. As discussed above, web 500 may be utilized to provide support and proper hand posture. Web 500 should, therefore, have sufficient rigidity to achieve these purposes. Web 500 should also have sufficient flexibility to permit the wearer to flex the hand when carrying or lifting heavy objects. Accordingly, the specific design of web 500 should balance the competing issues of rigidity and flexibility, which may be accomplished through the specific structure of web 500 and the materials utilized to form web 500.

The structure of web 500, as depicted in FIGS. 12 and 13, includes six openings 530 located on the back of the hand and adjacent to the metacarpal bones of the wearer. Web 500 includes, therefore, a plurality of segments 510 and junctions 520 that are located on the back of the hand, thereby providing both lateral and longitudinal rigidity in this area. Extensions 540 run onto the fingers and wrist from peripheral portions, thereby providing longitudinal rigidity on the fingers and on the wrist. Accordingly, the entire structure of web 500 resists a stretching in the longitudinal direction. Extensions 540, however, permit the fingers and wrist to be freely bent, thereby promoting flexibility, which is desirable when grasping objects.

The overall rigidity and flexibility of the web 500 may also be controlled through material selection. Suitable materials for web 500 will have properties that include flexibility, durability, and resilience, for example. Specific materials that are suitable for web 500 include a plurality of elastomeric materials such as natural rubber, nitrile rubber, polysulfide rubber, ethylene-propylene rubber, neoprene, butyl, latex, balata, ELASTOLLAN, which is a thermoplastic polyurethane elastomer that is produced by BASF Corporation, or PEBAX, which is a polyether block amide that is produced by Atofina Chemicals. Accordingly, for purposes of the present invention, the terms elastomer or elastomeric materials are intended to encompass a wide range of materials that are elastic and resilient, in addition to rubber. Other suitable materials for web 500 include materials that are not generally considered elastomers, but have properties that provide flexibility and strength that is sufficient for use with web 500, including chains formed of metals, synthetic leather, or natural leather, for example.

Materials having different densities may also be utilized to impart different properties to the various areas of web 500. For example, a thermoplastic polyurethane having a hardness of 80 on the Shore A scale, which is relatively soft, may be utilized for extensions 540 that extend over dorsal surfaces of the fingers and junctions 520 located over the knuckles. Another thermoplastic polyurethane having a hardness of 98 on the Shore A scale, which is relatively hard, may be utilized to form segments 510, junctions 520, and extensions 530 that correspond with the dorsal surface of the hand and wrist to provide additional support in these areas.

Segments 510 may be integrally-formed with each other to form a unitary structure, or each segment 510 may be individually formed and subsequently attached together at junctions 520. In addition, the shapes of segments 510 may vary. In cross-section, each segment 510 may have a flat surface adjacent to base portion 110 and a curved upper surface that faces outward. Alternatively, segments 510 may be square, round, or triangular, for example, in cross-section.

The various segments 510 and extensions 540 may have differing thicknesses or cross-sectional areas to accommodate varying stresses in different areas of glove 100. Similarly, junctions 520 may have varying sizes. As depicted in the figures, the junctions 520 adjacent to extensions 540 that extend onto the finger regions have greater sizes than other junctions 520. Varying the sizes of the elements of web 500 may also be utilized to reinforce high-wear areas.

The manner in which web 500 is attached to glove 100 may vary within the scope of the present invention. For example, an adhesive may be utilized to bond web 500 to base portion 110. Stitching that extends over segments 510 and extensions 540, and extends through base portion 110 may also be utilized. In addition, various welding or bonding processes may be utilized to melt the material forming web 500 and secure web 500 to the material forming glove 100. Another manner of attaching web 500 to glove 100 involves injecting a polymer material that forms web 500 directly onto the surface of glove 100. A portion of the polymer will then bond with the structure of the material, thereby attaching web 500 to glove 100. When a textile material is utilized to form the exterior of glove 100, the polymer may infiltrate the structure of the textile and surround individual fibers or filaments that comprise the textile. Upon cooling, the polymer material of web 500 will be effectively bonded to glove 100. As discussed above, polymer materials having dual hardnesses may be utilized for web 500. Polymer materials having dual hardnesses may be simultaneously injected onto the surface of glove 100 to provide an appearance of a single, uniform material.

The placement of web 500 may also vary. As depicted, the junctions 520 adjacent to extensions 540 that extend onto the finger regions are placed over the joints between the phalanges and the metacarpal bones (i.e., over the knuckles). In further embodiments, for example, web 500 may be designed to have four openings 530 that are positioned over the knuckles such that segments 510 extend between the knuckles.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. A glove comprising:

a base portion configured to cover at least a portion of a hand when the glove is worn, said base portion defining a longitudinal direction that extends between finger areas of said base portion and a wrist area of said base portion; and a web structure located on a dorsal side of said base portion, said web structure being formed of a flexible material and having a plurality of interconnected segments that define openings located between said segments, and said web structure including a plurality of extensions that extend into said wrist area of said base portion and are oriented to extend in said longitudinal direction.

2. The glove of claim 1, wherein said web structure is located on an area of said base portion corresponding with metacarpal bones of the hand.

3. The glove of claim 1, wherein said web structure includes a plurality of extensions that extend into said finger areas.

4. The glove of claim 1, wherein said segments are integrally formed with each other.

5. The glove of claim 1, wherein said web structure is adhesively bonded to said base portion.

6. The glove of claim 1, wherein said web structure includes segments having differing dimensions.

7. The glove of claim 1, wherein said web structure is formed of a polymer material.

8. The glove of claim 7, wherein said polymer material is selected from a group consisting of natural rubber, nitrile rubber, polysulfide rubber, ethylene-propylene rubber, neoprene, butyl, latex, balata, thermoplastic polyurethane, and polyether block amide.

9. A glove for covering at least a portion of a hand, said glove comprising:

a base portion configured to extend over at least a portion of the hand when the glove is worn, said base portion defining a longitudinal direction that extends between finger areas of said base portion and a wrist area of said base portion;

a protective portion attached to a palmar side of said base portion, said protective portion including a cushioning material; and a web structure attached to a dorsal side of said base portion, said web structure being formed of a flexible material and having a plurality of interconnected segments that define openings located between said segments, said web structure including a plurality of extensions that extend into a wrist area of said base portion and are oriented to extend in said longitudinal direction.

10. The glove of claim 9, wherein said web structure is located on a portion of said base portion corresponding with metacarpal bones of the hand.

11. The glove of claim 9, wherein said web structure includes a plurality of first additional extensions that extend into finger areas of said base portion.

12. The glove of claim 9, wherein said web structure is adhesively bonded to said base portion.

13. The glove of claim 9, wherein said web structure is formed of a polymer material.

14. The glove of claim 13, wherein said polymer material is selected from a group consisting of natural rubber, nitrile rubber, polysulfide rubber, ethylene-propylene rubber, neoprene, butyl, latex, balata, thermoplastic polyurethane, and polyether block amide.

15. A glove comprising:

a base portion for covering at least a portion of a hand; and a web structure located on a dorsal side of said base portion, said web structure being formed of a flexible material and having a plurality of interconnected segments that define openings located between said segments and have a configuration of a web, at least a portion of said openings being located in an area of said glove corresponding with metacarpal bones of the hand, and said web structure including a plurality of extensions, a first portion of said extensions extending into finger portions of said glove and a second portion of said extensions extending into a wrist portion of said glove, said second portion of said extensions extending in a longitudinal direction of said glove.

16. The glove of claim 15, wherein said segments and extensions are integrally formed with each other.

17. The glove of claim 15, wherein said web structure is adhesively bonded to said base portion.

18. The glove of claim 15, wherein said web structure is formed of a polymer material.

19. The glove of claim 18, wherein said polymer material is selected from a group consisting of natural rubber, nitrile rubber, polysulfide rubber, ethylenepropylene rubber, neoprene, butyl, latex, balata, thermoplastic polyurethane, and polyether block amide.

* * * * *